US005123643A

United States Patent [19]

Heilhecker et al.

[11] Patent Number: 5,123,643

[45] Date of Patent: Jun. 23, 1992

[54] BALL THROWING APPARATUS

[75] Inventors: Joe K. Heilhecker; Kathleen P. Heilhecker, both of Houston, Tex.

[73] Assignee: Perfect Pitch, Inc., Houston, Tex.

[21] Appl. No.: 735,999

[22] Filed: Jul. 25, 1991

[51] Int. Cl.[5] ..... A63B 65/12; A63B 69/40

[52] U.S. Cl. ..... 273/26 D; 124/21; 124/81

[58] Field of Search ..... 273/26 D; 124/17, 20.1, 124/21

[56] References Cited

U.S. PATENT DOCUMENTS

| | | | |
|---|---|---|---|
| 300,415 | 6/1884 | Van Allen . | |
| 310,873 | 1/1885 | Bradley . | |
| 317,119 | 5/1855 | Goodyear . | |
| 1,237,625 | 8/1917 | Ferguson | 124/20.1 |
| 1,261,992 | 4/1918 | Algie | 124/21 |
| 1,777,976 | 10/1930 | LaCoste | 273/26 X |
| 2,056,446 | 10/1936 | Dodge, Jr. | 124/21 |
| 2,080,958 | 5/1937 | Beasley | 273/26 D X |
| 2,267,163 | 12/1941 | Moser | 124/17 |
| 2,540,303 | 2/1951 | Sylvester | 124/21 |
| 2,645,218 | 7/1953 | Fisher | 124/21 |
| 3,277,878 | 10/1966 | Pankratz | 124/20.1 |
| 3,288,127 | 11/1966 | Bullock | 124/81 X |
| 3,610,222 | 10/1971 | Hartman | 124/81 X |
| 3,713,658 | 1/1973 | Cook | 273/26 D |
| 3,722,494 | 3/1973 | Slevin | 273/26 D X |
| 3,788,297 | 1/1974 | Borst | 124/7 |
| 3,802,409 | 4/1974 | Mike et al. | 124/20.1 |
| 3,819,179 | 6/1974 | Ambler, Jr. et al. | 273/26 B |
| 3,850,157 | 11/1974 | Prokupek | 273/26 D X |
| 3,892,217 | 7/1975 | Raty | 124/7 |
| 3,918,427 | 11/1975 | Turner | 124/20 |
| 3,963,017 | 6/1976 | Pfotenhauer | 124/21 |
| 3,974,820 | 8/1976 | Ott | 124/20.1 |
| 3,983,860 | 10/1976 | Bolton | 124/20.1 |
| 4,036,203 | 7/1977 | Chapman | 124/21 |
| 4,050,438 | 9/1977 | Pfotenhauer | 124/20 |
| 4,082,076 | 4/1978 | Perry | 124/7 |
| 4,125,106 | 11/1978 | Kelly | 124/17 |
| 4,169,453 | 10/1979 | Hunsicker | 124/20 |
| 4,240,396 | 12/1980 | Randoll | 124/17 |
| 4,261,319 | 4/1981 | Dixon | 124/21 |
| 4,323,047 | 4/1982 | McIntosh et al. | 124/81 X |
| 4,332,230 | 6/1982 | Lozier | 124/20 |
| 4,335,701 | 6/1982 | Bozich | 124/81 X |
| 4,345,577 | 8/1982 | Andersson | 124/16 |
| 4,411,248 | 10/1983 | Kivenson | 124/20 |
| 4,538,810 | 9/1985 | Brophy | 273/26 D |
| 4,632,088 | 12/1986 | Bruce | 124/78 |
| 4,651,707 | 3/1987 | Bozek | 124/17 |
| 4,703,744 | 11/1987 | Taylor et al. | 124/20 |
| 4,721,091 | 1/1988 | Ridley et al. | 124/26 |
| 4,844,045 | 7/1989 | Powell et al. | 124/7 |
| 4,860,717 | 8/1989 | Powell et al. | 124/7 |
| 4,883,272 | 11/1989 | Lay | 273/26 A |
| 4,907,802 | 3/1990 | Gatin | 273/26 R |
| 4,955,606 | 9/1990 | Leps | 273/26 D |

FOREIGN PATENT DOCUMENTS

| | | | |
|---|---|---|---|
| 665518 | 1/1952 | United Kingdom | 124/17 |

*Primary Examiner*—William H. Grieb

*Attorney, Agent, or Firm*—Pravel, Gambrell, Hewitt, Kimball & Krieger

[57] ABSTRACT

An apparatus for accurately and adjustably throwing a ball to a specific location with variable speed while causing the flight characteristics of the thrown ball to simulate those of a pitched or batted ball. The apparatus includes an elongated planar deck, a flexible pouch for receiving the ball to be thrown, and elastic straps connecting the ends of the pouch to rigid members attached to the planar deck. The entire apparatus is mounted on a support structure which may be anchored to the ground to provide stability. The ball to be thrown is placed in the pouch and rests on the deck. The pouch is drawn to the rear of the deck thereby tensioning the elastics and causing the pouch to form a flared U-shape around the ball. Upon release, the pouch propels the ball down the deck which imparts rotation to the ball to its point of release from the pouch.

12 Claims, 2 Drawing Sheets

FIG. 3
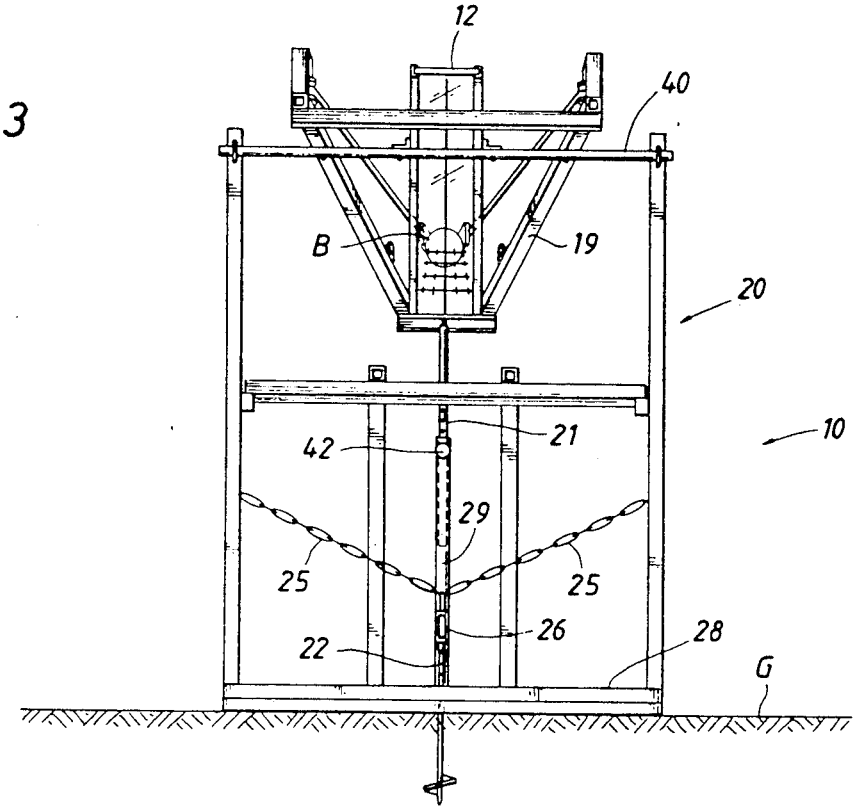
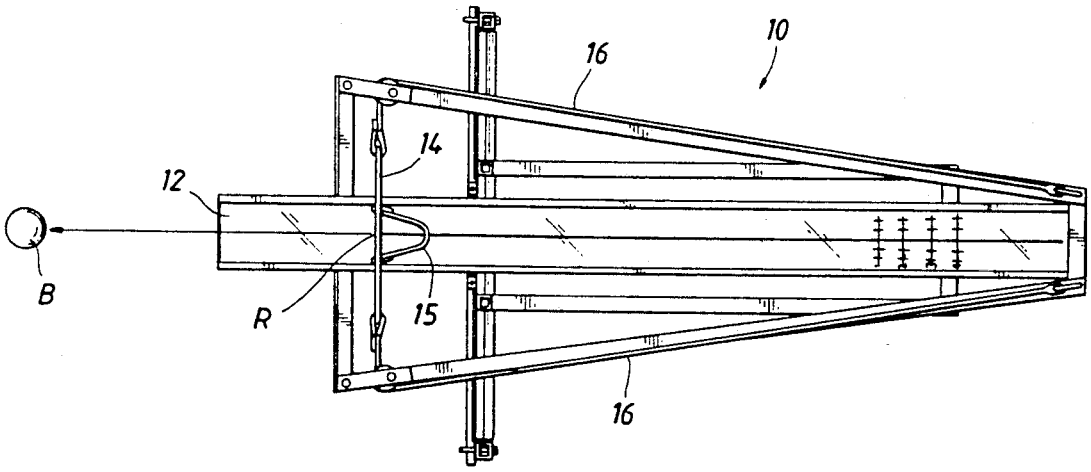
FIG. 4

BALL THROWING APPARATUS

BACKGROUND OF THE INVENTION

1. Field of the Invention

The invention generally relates to ball throwing devices, and more particularly, to a ball throwing apparatus for accurately and adjustably throwing a ball, such as a baseball or softball, to a specific location with variable speed.

2. Description of the Related Art

The popularity of baseball at all levels of competition has led to the development of numerous devices for throwing balls for batting and fielding practice. Many of these devices, however, are relatively complex and costly and do not adequately reproduce the flight characteristics of a pitched or batted ball. Additionally, many of these devices require an external source of electrical power which is often unavailable. These factors combine to make existing ball throwing devices largely unsuitable for use by the vast number of players who participate in the junior levels of competitive baseball.

The complexity of many of the existing ball throwing devices is illustrated by U.S. Pat. No. 1,237,625 issued to Ferguson. U.S. Pat. No. 1,237,625 discloses a mechanism for throwing balls for batting practice. Although a ball thrown by this mechanism may be aimed with relative precision, the device does not adequately simulate a pitched ball since its throwing cup does not apply rotation to the ball as it is thrown. U.S. Pat. Nos. 3,277,878 and 3,802,409, issued to Pankratz and Mike et al., respectively, are typical of those throwing devices which utilize elastics to project the ball. While relatively simple and inexpensive, these devices provide only limited directional control of the thrown ball and do not apply rotation to the ball as it is released. They are thus incapable of fully simulating the flight characteristics of a pitched or batted ball.

At very junior levels of competition, involving young children and amateur coaches, it is particularly difficult for the coaches to pitch for batting practice. Fear of hitting the child causes the coach to pitch very slowly in an attempt to guide the ball. The result is an almost complete loss of control of the pitch causing the ball to miss the strike zone. A relatively large number of pitches must therefore be thrown in relation to the number which are suitable for the batter to hit.

Therefore, there is a need for a manually powered ball throwing apparatus which is capable of accurately and adjustably throwing a ball to a specific, predetermined location simulating the flight characteristics of a pitched or batted ball.

SUMMARY OF THE INVENTION

The present invention is directed to accurately throwing a ball, such as a baseball or softball, to a specific location. The apparatus of the present invention, by imparting rotation to the ball, causes the flight characteristics of the thrown ball to simulate those of a pitched or batted ball thus making the apparatus suitable for use in batting or fielding practice. The apparatus is manually operated and requires no external power source.

An elongated planar deck is mounted on a support structure which is securely anchored to the ground. A flexible ball receiving pouch is attached to elastics which are connected to the deck. The ball receiving pouch is thus located slightly above the top surface of the deck, and when the elastics are in their relaxed position the deck projects beyond the ball receiving pouch in the direction of throw.

The ball to be thrown is placed in the front portion of the ball receiving pouch and rests on the deck. As the pouch is drawn back, the tension in the elastics is increased. Once the operator releases the pouch, the tension in the elastics causes the pouch to propel the ball rapidly over the surface of the deck. As the pouch moves along the deck the ball is caused to rotate by virtue of its contact with the deck. The rotation which is applied to the ball by the deck is applied substantially continuously to the ball's point of release. This controlled rotation enables the flight characteristics of the thrown ball to accurately simulate those of a pitched or batted ball. A hitter or fielder can therefore practice effectively under game conditions.

This description is intended as a summary only and is not intended to represent the scope of patent protection sought or obtained. The Description of the Preferred Embodiment will describe the invention in detail and the claims are intended to describe the scope of the invention.

BRIEF DESCRIPTION OF THE DRAWINGS

A better understanding of the present invention can be had when the following detailed description of the preferred embodiment is considered in conjunction with the following drawings, in which:

FIG. 3 is a front elevation view of the ball throwing apparatus of FIG. 1; and FIG. 4 is a plan view of the ball throwing apparatus illustrated with the elastics in their relaxed position immediately after release of a ball.

DESCRIPTION OF THE PREFERRED EMBODIMENT

While the present invention will be described in connection with the throwing of a baseball or softball, it is understood that the present invention may be used to throw other types of projectiles.

Figure 1:
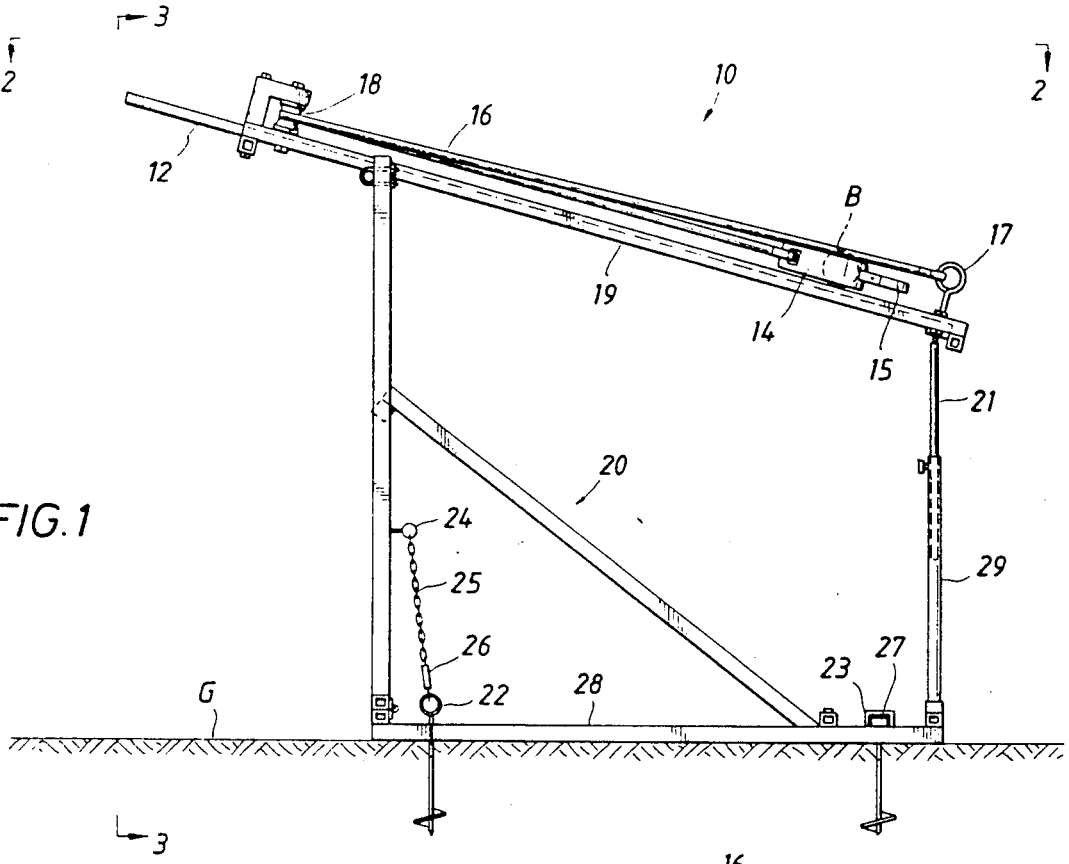
FIG. 1 is a side elevation view of the preferred embodiment of a ball throwing apparatus according to the present invention illustrated with the elastics under tension and the ball receiving pouch containing a ball ready for throwing.

Referring now to FIG. 1, the reference numeral 10 generally indicates a ball throwing apparatus according to the present invention. This embodiment of the present invention is suitable for throwing a baseball or softball. The ball throwing apparatus 10 includes a deck 12, a ball receiving pouch 14 with pouch handle 15, elastics 16, elastic attachment anchors 17, capstans 18, a deck frame 19, and a support structure 20. Each end of the ball receiving pouch 14 is attached to an elastic 16. Each elastic 16 is deployed about a capstan 18 rotatably mounted on the deck frame 19, and is then attached to an elastic attachment anchor 17. The elastic attachment anchors 17 are rigidly attached to the deck frame 19. The front of the deck frame 19 is pivotally attached to the support structure 20 so that the inclination of the deck 12, relative to the support structure 20 and the surface of the ground G, can be adjusted by raising or lowering the deck incline adjustment rod 21. In preparation for throwing a ball B, the ball throwing apparatus 10 is first rigidly anchored to the ground G by means of a front anchor stake 22 and a rear anchor stake 23. The support structure 20 is fitted with dual anchor eyes 24. An anchor chain 25 connects each anchor eye 24 to the front anchor turnbuckle 26. The front anchor turnbuckle 26 is slidably attached to the front anchor stake 22. The front of the ball throwing apparatus 10 is thus anchored by turning the front anchor stake 22 into the ground G and finally adjusting the tension in the anchor chains 25 by means of the front anchor turnbuckle 26. The rear of the ball throwing apparatus 10 is anchored by turning the rear anchor stake 23 into the ground G until the desired pressure is applied to the rear anchor bar 27. The rear anchor bar 27 rests atop the base members 28 of the support structure 20 and depresses them into the ground G. The inclination of the deck 12 is next adjusted to produce the desired trajectory of the thrown ball by raising or lowering the deck incline adjustment rod 21. The deck incline adjustment rod 21 is slidably inserted in the rear vertical member 29 of the support structure 20. A ball B is placed in the ball receiving pouch 14. The ball receiving pouch 14 is drawn back by means of the pouch handle 15, thus placing the elastics 16 in tension. The relative heights of the elastic attachment anchors 17 and the capstans 18 above the deck 12 are such that, when the elastics 16 are placed in tension in preparation for throwing a ball B, the points at which the elastics 16 attach to the ball receiving pouch 14 are closer to the deck 12 than the points at which the elastics 16 deploy about the capstans 18 and the points at which the elastics 16 attach to the elastic attachment anchors 17. This arrangement imparts a slight lift to the ball B as it moves along the deck 12 after the pouch handle 15 is released. While the ball B never loses contact with the deck 12 as it travels toward its point of release from the ball receiving pouch 14, this slight lifting effect prevents the ball B from sliding on the deck 12 and permits the ball B to rotate freely as it moves over the surface of the deck 12. The bottom rear of the ball receiving pouch 14 should ideally be placed in contact with the deck 12 just before the pouch handle 15 is released. This ensures that the ball receiving pouch 14 will not tend to ride over the top of the ball B as the ball B is propelled along the deck 12.

Figure 2A:
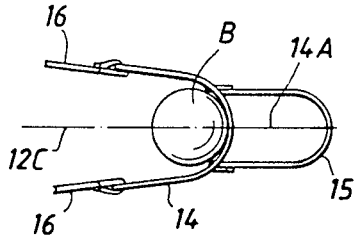
FIG. 2A is a plan view of the ball receiving pouch containing a ball ready for throwing along a straight path.
Figure 2:
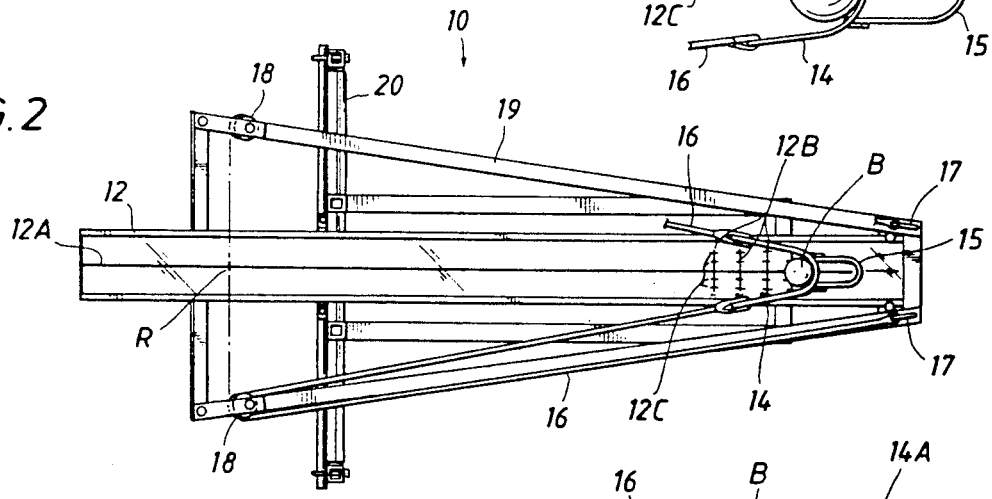
FIG. 2 is a plan view of the ball throwing apparatus of FIG. 1.

Referring now to FIG. 2, the speed and direction of the thrown ball B are determined by the position of the ball B on the deck 12 at the time the pouch handle 15 is released. The deck 12 is marked with a centerline 12A in the direction of throw. The deck 12 is further marked with a series of positioning lines 12B, perpendicular to the centerline 12A, and a series of offset lines 12C. The offset lines 12C radiate from the release point R of the ball B. The release point R is the point at which the ball B loses contact with the ball receiving pouch 14 as the tension in the elastics 16 is released. The release point R is located at the intersection of the centerline 12A and a line drawn between the opposing capstans 18, which line corresponds to the position of the ball receiving pouch 14 when the elastics 16 are in their fully relaxed position. The offset lines 12C are essentially parallel to the centerline 12A at the points where they intersect the positioning lines 12B on both sides of the centerline 12A. The positioning lines 12B are sequentially numbered, with higher numbers denoting increasing tension in the elastics 16 when the ball receiving pouch 14 is drawn back to the designated line. Thus, as the ball receiving pouch 14 is progressively drawn back to higher numbered positioning lines 12B the speed of the ball B upon release is progressively and controllably increased. The offset lines 12C may be used to control the direction of the thrown ball B. As the position of the ball receiving pouch 14 is offset from the centerline 12A with the elastics 16 under tension, the direction of throw of the ball B is inversely altered in proportion to the degree of offset.

Referring now to FIG. 2A, the configuration of the ball receiving pouch 14 is detailed with the elastics 16 in tension. The overall length of the ball receiving pouch 14 measured along the pouch 14 between its attachment points to the elastics 16 is preferably greater than the circumference of the ball B to be thrown. The overall width of the flat belt comprising the ball receiving pouch 14 is preferably between about 75 and 85 percent of the diameter of the ball B to be thrown. The stiffness of the material of the ball receiving pouch 14 must be such that, when the pouch 14 forms a flared U-shape with the elastics 16 in tension, only the rear of the ball B is contacted by the pouch 14. This permits the ball B to rotate freely as it is propelled forward following release of the pouch handle 15. Should the ball receiving pouch 14 contact the sides of the ball B, rotation of the ball B, which causes its flight characteristics to simulate those of a pitched or batted ball, would be impaired. If, as shown, the centerline 14A of the ball receiving pouch 14 is aligned with the selected offset line 12C before the pouch handle 15 is released, the ball B will follow a straight path when it is thrown.

Figure 2B:
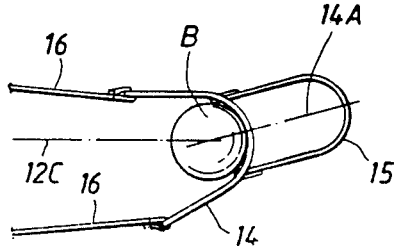
FIG. 2B is a plan view of the ball receiving pouch containing a ball ready for throwing along a curved path.

Referring now to FIG. 2B, the configuration of the ball receiving pouch 14 for throwing a "curve ball" is detailed. If, as shown, the centerline 14A of the ball receiving pouch 14 is skewed from the selected offset line 12C by applying a greater force to one side of the pouch handle 15 before release, the ball B will follow a curved path when it is thrown.

Referring now to FIG. 3, the mechanism for adjusting the inclination of the deck 12 to control the trajectory of the thrown ball B is more clearly illustrated. The front of the deck frame 19 is pivotally and removably attached to the axle member 40 of the support structure 20. The rear of the deck frame 19 is removably attached to the deck incline adjustment rod 21. The deck frame 19 and all components mounted on it, including the deck 12, are thus removable from the support structure 20. This permits the support structure 20 to remain anchored to the ground G for extended periods covering multiple practice sessions, while the operative assembly of the ball throwing apparatus 10 is removed to prevent damage or theft. The inclination of the deck 12 is increased by reducing the height of the deck incline adjustment rod 21. This is accomplished by inserting the deck incline adjustment rod 21 more deeply into the rear vertical member 29 of the support structure 20 and locking it in position with the incline adjustment locking means 42. Correspondingly, the inclination of the deck 12 is reduced by increasing the height of the deck incline adjustment rod 21 by progressively withdrawing it from the rear vertical member 29. In the preferred embodiment of the present invention the deck 12 is preferably constructed of a transparent material to aid the batter or fielder in tracking the timing and speed of release of the ball.

Referring now to FIG. 4, once the pouch handle 15 is released the energy stored in the elastics 16 causes the ball receiving pouch 14 to propel the ball B along the deck 12 to the release point R. As the ball B is propelled along the deck 12 it is caused to rotate because of its contact with the deck 12. Simultaneously, the ball receiving pouch 14 gradually expands from its flared U-shape, when the elastics 16 are under tension, to a flat belt shape when the release point R is reached and the elastics 16 are fully relaxed. The deck 12 extends beyond the release point R for a distance sufficient to ensure that rotation is applied to the ball B until it loses contact with the ball receiving pouch 14. The extension of the deck 12 beyond the release point R also prevents the ball receiving pouch 14 from binding on the end of the deck 12 due to any overshoot which may occur before the ball receiving pouch 14 comes to rest.

In the preferred embodiment of the ball throwing apparatus 10 the deck 12 is preferably constructed of a clear, polycarbonate resin material. The ball receiving pouch 14 is preferably constructed of leather, the elastics 16 of surgical rubber tubing, and the capstans 18 of a material with a relatively low coefficient of friction, such as Teflon, manufactured by the DuPont Company. The support structure 20 is preferably constructed of aluminum to reduce weight and enhance transportability.

While the presently preferred embodiment of the invention has been given for the purpose of disclosure, numerous changes in the details of construction and arrangement of parts will be readily apparent to those skilled in the art and are encompassed within the spirit of the invention and the scope of the appended claims.

We claim:

1. A ball throwing apparatus for substantially continuously applying rotation to the ball to its point of release, the apparatus comprising:

a planar deck;

at least one elastic strap;

anchor means mounted with said planar deck and attached to said at least one elastic strap to anchor said strap when tensioned;

a ball receiving pouch attached to said elastic strap to receive a ball to be thrown, said strap being tensioned by drawing back said pouch containing the ball;

said anchor means, said strap and said pouch being aligned to maintain substantially continuous engagement between the ball and said planar deck to the point of release of the ball from said pouch such that rotation as well as acceleration is imparted to the ball when the tension in said elastic strap is released.

2. The apparatus of claim 1, wherein:

said planar deck includes a ball traveling path extending continuously from the point of furthest tension of said elastic strap and pouch to the point of release of the ball from said pouch such that the ball is in continuous engagement with said deck during its entire forward travel.

3. The apparatus of claim 2, wherein:

said planar deck is constructed of a transparent material;

said planar deck is marked with a centerline substantially in the direction of throw;

said planar deck is marked with multiple, numbered positioning lines perpendicular to said centerline; and said planar deck is further marked with multiple offset lines intersecting said positioning lines on both sides of said centerline and being substantially parallel to said centerline thereby permitting the operator to precisely position said ball receiving pouch when said elastic strap is placed in tension.

4. The apparatus of claim 1, further comprising:

a support structure to which said planar deck is pivotally attached; and inclination control means permitting the operator to selectively vary the angle of said planar deck relative to said support structure.

5. The apparatus of claim 4, wherein:

said support structure is comprised of a framework of rigid members; and said planar deck is removably attached to said support structure.

6. The apparatus of claim 1, further comprising:

multiple guide means about which said elastic strap is slidably deployed;

said guide means being rotatably secured to said support structure.

7. The apparatus of claim 1, wherein:

said ball receiving pouch forms a flared U-shaped pocket when said elastic strap is placed in tension by the operator; and said ball receiving pouch is substantially flat when said elastic strap reaches its relaxed position at the point of release of the ball such that said pouch does not substantially contact the sides of the ball thereby permitting the ball to rotate freely during its forward travel.

8. The apparatus of claim 7, wherein:

the ball may be made to follow a curved flight path upon release by skewing the position of said pouch relative to the intended direction of throw after said elastic strap have been tensioned.

9. The apparatus of claim 7, wherein:

said ball receiving pouch is comprised of a flat belt of flexible, yet relatively stiff, material;

the length of said ball receiving pouch between its attachment points to said elastic strap is greater than the circumference of the ball to be thrown; and the width of said ball receiving pouch is between about 75 and 85 percent of the diameter of the ball to be thrown.

10. The apparatus of claim 1, wherein, when said elastic strap is placed in tension by the operator, the distance between said elastic strap and said planar deck is greatest at said anchor means.

11. A ball throwing apparatus for substantially continuously applying rotation to the ball to its point of release, the apparatus comprising:

a planar deck constructed of a transparent material;

at least one elastic strap;

anchor means mounted with said planar deck and attached to said at least one elastic strap to anchor said strap when tensioned;

a ball receiving pouch attached to said elastic strap to receive a ball to be thrown, said strap being tensioned by drawing back said pouch containing the ball;

said anchor means, said strap and said pouch being aligned to maintain substantially continuous engagement between the ball and said planar deck to the point of release of the ball from said pouch such that rotation as well as acceleration is imparted to the ball when the tension in said elastic strap is released; and wherein said planar deck includes a ball traveling path extending continuously from the point of furthest tension of said elastic strap and pouch to the point of release of the ball from said pouch such that the ball is in continuous engagement with said deck during its entire forward travel.

12. The apparatus of claim 11, wherein:

said planar deck is marked with a centerline substantially in the direction of throw;

said planar deck is marked with multiple, numbered positioning lines perpendicular to said centerline; and said planar deck is further marked with multiple offset lines intersecting said positioning lines on both sides of said centerline and being substantially parallel to said centerline thereby permitting the operator to precisely position said ball receiving pouch when said elastic strap is placed in tension.

* * * * *